US009159524B2

(12) United States Patent
Horvarth et al.

(10) Patent No.: US 9,159,524 B2
(45) Date of Patent: Oct. 13, 2015

(54) X-RAY GENERATING APPARATUS

(71) Applicant: RIGAKU CORPORATION, Tokyo (JP)

(72) Inventors: Martin Horvarth, Prague (CZ); Jiri Marsik, Prague (CZ); Ladislav Pina, Prague (CZ); Vaclav Jelinek, Brandysek (CZ); Naohisa Osaka, Tokyo (JP); Kazuhiko Omote, Tokyo (JP); Makoto Kambe, Tokyo (JP); Licai Jiang, Rochester Hills, MI (US); Bonglea Kim, Sterling Heights, MI (US)

(73) Assignee: RIGAKU CORPORATION, Tokyo (JP)

( * ) Notice: Subject to any disclaimer, the term of this patent is extended or adjusted under 35 U.S.C. 154(b) by 107 days.

(21) Appl. No.: 14/055,453

(22) Filed: Oct. 16, 2013

(65) Prior Publication Data

US 2014/0105367 A1 Apr. 17, 2014

(30) Foreign Application Priority Data

Oct. 17, 2012 (JP) ..... 2012-230115

(51) Int. Cl.
*H01J 35/14* (2006.01)

(52) U.S. Cl.
CPC ..... *H01J 35/14* (2013.01); *H01J 2235/081* (2013.01); *H01J 2235/083* (2013.01)

(58) Field of Classification Search
CPC ..... H01J 35/14; H01J 35/02; H01J 2235/081; H01J 2235/083
USPC ..... 378/138
See application file for complete search history.

(56) References Cited

U.S. PATENT DOCUMENTS

| | | | | |
|---|---|---|---|---|
| 5,128,977 | A | 7/1992 | Danos | |
| 5,206,895 | A | 4/1993 | Danos | |
| 5,506,482 | A | 4/1996 | Teramatsu et al. | |
| 6,282,263 | B1 | 8/2001 | Arndt et al. | |
| 6,421,422 | B1 | 7/2002 | Lifshin et al. | |
| 6,778,633 | B1 | 8/2004 | Loxley et al. | |
| 7,067,820 | B2 | 6/2006 | Buijsse | |
| 7,428,298 | B2 | 9/2008 | Bard et al. | |
| 7,443,953 | B1 | 10/2008 | Yun et al. | |
| 2004/0211914 | A1 | 10/2004 | Buijsse | |
| 2007/0025516 | A1 | 2/2007 | Bard et al. | |
| 2012/0269326 | A1 * | 10/2012 | Adler et al. | 378/138 |

FOREIGN PATENT DOCUMENTS

| | | | |
|---|---|---|---|
| EP | 1 146 542 | A1 | 10/2001 |
| EP | 1 471 562 | A2 | 10/2004 |

(Continued)

*Primary Examiner* — Courtney Thomas
(74) *Attorney, Agent, or Firm* — Birch, Stewart, Kolasch & Birch, LLP

(57) ABSTRACT

The X-ray generating apparatus 100 applies an electron beam e1 onto a target 150 to generate X-rays x1, and includes a permanent magnet lens 120 configured to focus the electron beam e1, a correction coil 130 provided on a side of the electron beam e1 with respect to the permanent magnet lens 120 and configured to correct a focus position formed by the permanent magnet lens 120 in a traveling direction of the electron beam e1, and a target 150 onto which the focused electron beam is applied. Accordingly, the apparatus configuration can be extremely compact and lightweight in comparison with general apparatuses. Furthermore, by the correction coil 130, the intensity of the magnetic field can be finely adjusted and the focus position in the traveling direction of the electron beam e1 can be finely adjusted.

10 Claims, 12 Drawing Sheets

(56) References Cited

FOREIGN PATENT DOCUMENTS

| | | | |
|---|---|---|---|
| JP | 58-145049 | A | 8/1983 |
| JP | 2000-82430 | A | 3/2000 |
| WO | WO 92/03837 | A1 | 3/1992 |
| WO | WO 2006/105332 | A2 | 10/2006 |
| WO | WO 2008/017376 | A1 | 2/2008 |

* cited by examiner

| | Spot size H(μm) x V(μm) | X- ray intensity (mV) | Relative X - ray intensity |
|---|---|---|---|
| Example 1 | 24 x 22 | 167.6 | 0.88 |
| Example 3 | 22 x 19 | 190.5 | 1.00 |

FIG. 7

X-RAY GENERATING APPARATUS

BACKGROUND OF THE INVENTION

1. Field of the Invention

The present invention relates to an X-ray generating apparatus that applies an electron beam onto a target to generate X-rays.

2. Description of the Related Art

So far, as an X-ray generation source that generates X-rays with a reduced-focus size, a micro-focus X-ray generating apparatus has been widely used. A general X-ray generating apparatus accelerates thermoelectrons emitted from a heated cathode and causes them to collide with a target to emit X-rays. Since an electron current toward the target spreads, application of an appropriate electric field to Wehnelt suppresses spread of the electron current, to thereby cause the electron current to be focused on the target. Since the electron beam minutely reduced in size needs to be applied onto the target, there is known the micro-focus X-ray generating apparatus that controls focusing of the electron beam by using various means.

For example, the X-ray generating apparatus described in the Patent Document 1 includes an X-ray focusing device using an X-ray reflection mirror in addition to a basic configuration including an X-ray tube, an electron gun, an X-ray target, an electron lens, a stigmator, and an X-ray window, to thereby generate X-rays with the focus of compact size or a focus line.

The X-ray focusing apparatus according to the Patent Document 2 are used in two planes, and includes two sets of beam deflection coils provided between an anode of the electron gun and a focusing lens by an electromagnet, to thereby focus the beam onto the center. Furthermore, the X-ray focusing apparatus has an air-cored quadripole magnet as the stigmator that is provided between the focusing lens and the target and that changes the beam having a circular cross-section into an elongated shape. This quadripole can be rotated about the tube axis, to thereby be capable of adjusting the direction of the line focus, and the beam can be moved on the target surface by controlling currents in the four coils of the quadripole.

A compact-type X-ray tube described in the Patent Document 3 adjusts a focus position in the traveling direction of an electron beam and a focus position on the target through the use of an annular permanent magnet provided outside a small diameter portion in order to focus the electron beam on a minute range portion of the target. However, an adjustment method is performed by moving the permanent magnet along the small diameter portion.

FIG. 11 is a perspective cross-sectional view illustrating a conventional X-ray generating apparatus 300 as described above. The X-ray generating apparatus 300 includes an alignment coil 310, an electromagnetic lens 320, a stigmator 340, a target 350, and an X-ray extraction window 360. FIG. 12 is a perspective view illustrating an incident angle $\alpha$3 of an electron beam e3 with respect to a target 350 and illustrating a take-off angle $\beta$3 of X ray x3. The incident angle $\alpha$3 is set to be large, approximately 78 degrees, and the conventional X-ray generating apparatus 300 irradiates the target with the electron beam by extension of the cross-section of the electron beam by the stigmator 340 and then the X ray is extracted at the X-ray take-off angle is $\beta$3 thereof that is set to be small, approximately, for example, 12 degrees. A range surrounded with a broken line illustrated in FIG. 12 indicates an irradiation range of the electron beam on the target. An X-ray generating apparatus 300 causes the electron beam that is generated by the cathode and has passed through a aperture 305, to be focused by an electromagnetic lens 320 that accounts for a large volume of the apparatus.

PATENT DOCUMENT

[Patent Document 1]
U.S. Pat. No. 6,282,263 Specification
[Patent Document 2]
U.S. Pat. No. 6,778,633 Specification
[Patent Document 3]
Japanese Patent Application Laid-Open No. S58-145049

As described above, since the electromagnetic lens that focuses the electron beam accounts for a large volume, it is hard to configure the compact apparatus. However, there are demands for the X-ray generating apparatus having a compact and lightweight configuration. In response to the demands, there can be conceived a method for focusing the electron beam through the use of a permanent magnet having a more compact volume and generating a stronger magnetic field than an electromagnetic lens. However, even if the electron beam is focused using the permanent magnet, the focus position cannot be finely controlled because of a fixed intensity of the magnetic field.

When the electron beam is focused using the permanent magnet, because of electro-radiative fluctuation due to dimension change of a cathode by aging change and thermal expansion, fluctuation of a magnetic force of a permanent magnet due to heat change, movement of the focus position due to fluctuation of a voltage, displacement of focus position due to temperature rise of a target and dimension change of an X-ray tube and the like, only the permanent magnet cannot always stably generate X-rays.

SUMMARY OF THE INVENTION

The present invention has been made in consideration of the above-described problems, and is directed to provide an X-ray generating apparatus that has a compact and lightweight configuration and can finely adjust a focus position of an electron beam.

(1) In order to achieve the above-described purpose, the X-ray generating apparatus of the present invention applies electron beam onto a target to generate X-rays, and includes a permanent magnet lens configured to focus the electron beam, a correction coil provided on a side of the electron beam with respect to the permanent magnet lens and configured to correct a focus position formed by the permanent magnet lens in a traveling direction of the electron beam, and a target onto which the focused electron beam is applied.

As described above, since the permanent magnet is used as an electron lens, an extremely compact and lightweight configuration of an apparatus can be realized in comparison with general apparatuses. Moreover, the magnetic intensity can be finely adjusted through the use of a correction coil, and thus the focus position in the traveling direction of the electron beam can be finely adjusted. Meanwhile, the X-ray generating apparatus of the present invention basically includes an X-ray tube, an electron gun, a target, an alignment coil, a permanent magnet lens, a correction coil, and an X-ray extraction window.

(2) In addition, in the X-ray generating apparatus of the present invention, the correction coil is installed within a magnetic force range of a magnetic field of the permanent magnet lens in a traveling direction of the electron beam. With this arrangement, an outer dimension of the X-ray generating apparatus in the traveling direction of the electron beam can be reduced. Furthermore, the size of the correction coil can be reduced. Meanwhile, the above-described magnetic force range refers to a range in which the magnetic force of the permanent magnet lens corresponds to 68% or more of a maximum magnetic force of the permanent magnet lens. The correction coil is preferably provided on a side of an electron beam path of the permanent magnet lens.

For example, when the permanent magnet has a cylindrical shape, the correction coil is preferably installed inside a hole of the permanent magnet lens. However, even though the correction coil is not provided strictly inside the hole of the permanent magnet lens, it can be provided within the magnetic force range of the permanent magnet lens near an end surface thereof.

(3) Furthermore, in the X-ray generating apparatus of the present invention, the target is installed with a surface of the target inclined with respect to the electron beam such that the incident angle of the electron beam is 3 to 20 degrees. Therefore, the electron beam spreads obliquely and is applied onto the target, and thus by application of a large load without causing the target to reach a high temperature exceeding a melting point, the X ray having high intensity can be extracted.

(4) Furthermore, the X-ray generating apparatus of the present invention further includes an X-ray extraction window configured to extract X-rays generated on the target, outside the apparatus, and the X-ray extraction window is installed at a position where an X-ray take-off angle with respect to a surface of the target is almost the same angle as an incident angle of the electron beam with respect thereto. With this arrangement, the apparent focus point size of an X-ray source can be reduced and thus X-rays having high intensity can be extracted.

(5) Moreover, the X-ray generating apparatus of the present invention further includes the X-ray extraction window configured to extract X-rays generated on the target, outside the apparatus, and the X-ray extraction window is installed such that a surface of the X-ray extraction window is substantially parallel to the electron beam and substantially vertical with respect to the surface of the target. With this arrangement, the linearly-spread and line-focused X-rays can be extracted.

(6) Furthermore, in the X-ray generating apparatus of the present invention, the target is formed into a thin film, on a diamond substrate. With this arrangement, heat generated on the thin film can be spread by the diamond. Furthermore, since the X-ray generating apparatus of the present invention is premised on glancing incidence, even if the thin film for the target is made thinner, an incident electron acts on the target and a sufficient X-ray intensity is obtained.

According to the present invention, through the use of the compact and lightweight configuration of the apparatus, the focus position of the electron beam can be finely adjusted.

BRIEF DESCRIPTION OF THE DRAWINGS

FIG. 7 is a table illustrating a result of an experiment.

DETAILED DESCRIPTION OF THE INVENTION

Figure 1:
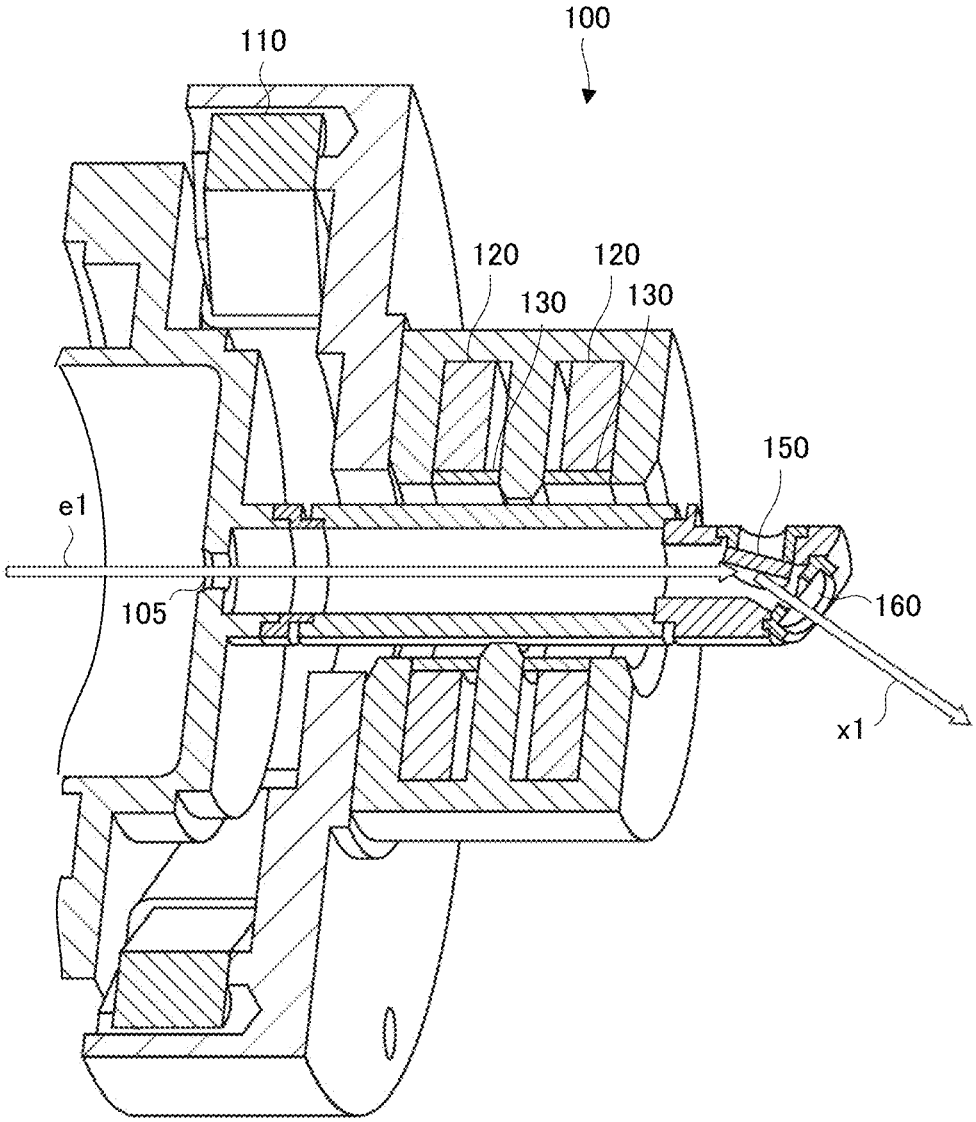
FIG. 1 is a perspective cross-sectional view illustrating an X-ray generating apparatus according to a first embodiment.

Next, with reference to drawings, an embodiment of the present invention will be described. For easier understanding of description, the same reference numeral is attached to the same component in each drawing, and the repeated explanation thereof is omitted. Meanwhile, the embodiment illustrated in the drawings is one example, and the present invention is not limited thereto.

First Embodiment

FIG. 1 is a perspective cross-sectional view illustrating an X-ray generating apparatus 100. The X-ray generating apparatus 100 includes an alignment coil 110, a permanent magnet lens 120, a correction coil 130, a target 150, and an X-ray extraction window 160. The X-ray generating apparatus 100 applies a high voltage of few dozens kilovolt with a cathode serving as a negative electrode and the target 150 serving as a positive electrode and thus causes the electron beam generated by the cathode to collide with the target 150, to thereby generate X rays. Meanwhile, FIG. 1 illustrates a configuration for controlling the focusing of the electron beam, but does not illustrate a peripheral portion of the cathode.

Generally, the cathode is heated by electric conduction, to emit thermoelectrons. While the traveling direction of the emitted electron beam is controlled by a control voltage applied to the Wehnelt, the emitted electron beam is accelerated by a high voltage applied between the cathode and the target, to thereby collide with the target 150, and thus the X-ray is generated from the target when the collision takes place, and then the X ray spreads in a wide-angle region.

The alignment coil 110 is provided right behind an aperture 105 to adjust a position and a cross-sectional shape on a plane perpendicular to the traveling direction of the electron beam e1. Since the alignment coil 110 is used for adjusting the position of the electron beam on the plane, two sets of alignment coils 110 are provided depending on two directions on the plane perpendicular to the traveling direction of the electron beam.

The permanent magnet lens 120 is provided at a subsequent stage of the alignment coil 110, and focuses the electron beam e1 by the magnetic field as the electron lens. Since the permanent magnet lens instead of the electromagnetic lens is used as the electron lens, the extremely compact and lightweight configuration of the apparatus can be realized in comparison with conventional apparatuses.

The correction coil 130 is installed within a magnetic force range of the magnetic field of the permanent magnet lens 120 in the traveling direction of the electron beam e1, and further, is provided on a side of the electron beam e1 with respect to the permanent magnet lens 120. The correction coil 130 can correct the focus position in the traveling direction of the electron beam e1 formed by the permanent magnet lens 120 and can adjust the focus position of the electron beam, with a small current of 1 A or less. The correction coils 130 are configured axisymmetrically with respect to an axis that is the traveling direction of the electron beam, and can be formed into a round shape, a cylindrical shape or a barrel shape, about the axis. Furthermore, as the alignment coil 110 as described above, the correction coils may be formed into a block shape and installed symmetrically about the axis. The correction coil 130 finely adjusts the intensity of the magnetic field, and thus fine adjustment of the focus position in the traveling direction of the electron beam becomes possible. The magnetic force range is a range in which the magnetic force of the permanent magnet lens 120 corresponds to 68% or more of the maximum magnetic force of the permanent magnet lens 120. In addition, the correction coil 130 is further preferably provided on the side of the electron beam path of the permanent magnet lens 120.

For example, when the permanent magnet lens 120 has a cylindrical shape, the correction coil 130 is preferably installed inside the hole of the permanent magnet lens 120. However, even though the correction coil 130 is not provided strictly inside the hole of the permanent magnet lens 120, it can be provided within the magnetic force range of the permanent magnet lens 120 near the end surface thereof.

Since the correction coil 130 is installed within the magnetic force range of the permanent magnet lens 120 in the traveling direction of the electron beam e1, an outer dimension of the X-ray generating apparatus 100 therein can be reduced. Furthermore, in comparison with a case where the correction coil 130 is installed outside the magnetic force range of the permanent magnet lens 120, the size of the correction coil 130 can be reduced.

If the correction coil 130 is installed outside the magnetic force range of the permanent magnet lens 120, for example, on a side of the target 150, the amount of displacement that has been unable to be adjusted by the permanent magnet lens 120 increases and the amount to be corrected becomes larger, and thus the size of the correction coil 130 itself needs to be increased. If the permanent magnet lens 120 is installed within the magnetic force range, the small amount of the correction is required, and thus the size of the correction coil 130 itself needs not be large.

The focused electron beam e1 is applied onto the target 150 to generate X-ray x1. Metal to be a positive electrode such as Cu, Mo, or W is used for the target 150. As illustrated in FIG. 1, the target 150 is installed greatly inclined with respect to the traveling direction of the electron beam, and is provided such that the incident angle of the electron beam e1 is 3 to 20 degrees.

With this arrangement, even if the cross-sectional shape of the electron beam is not extended, the target can be irradiated with the electron beam over a long range in the traveling direction of the electron beam. As a result, without damaging the target 150, X-rays having a sufficient intensity can be extracted. As described above, since the target 150 greatly inclines toward the electron beam, means for performing adjustment for ensuring the X-ray intensity becomes unnecessary, thereby realizing the compact and simple apparatus.

The X-ray extraction window 160 is formed of, for example, Be (Beryllium), and the X-ray generated on the target 150 is extracted outside of the apparatus. Of X-rays generated by collision of the electron beam with the target and emitted within the wide-angle region, the X-ray emitted in the direction of the X-ray extraction window 160 is extracted outside the apparatus.

Positions of the X-ray extraction window 160 can be conceived variously depending on a use embodiment. As an embodiment, it is preferable that the position of the X-ray extraction window 160 be installed at a position where the X-ray take-off angle with respect to the surface of the target 150 is almost the same angle as the incident angle of the electron beam with respect thereto. Therefore, with the apparent focus size of an X-ray source remaining compact, application of a large load makes it possible to extract X-rays having high intensity.

Figure 2:
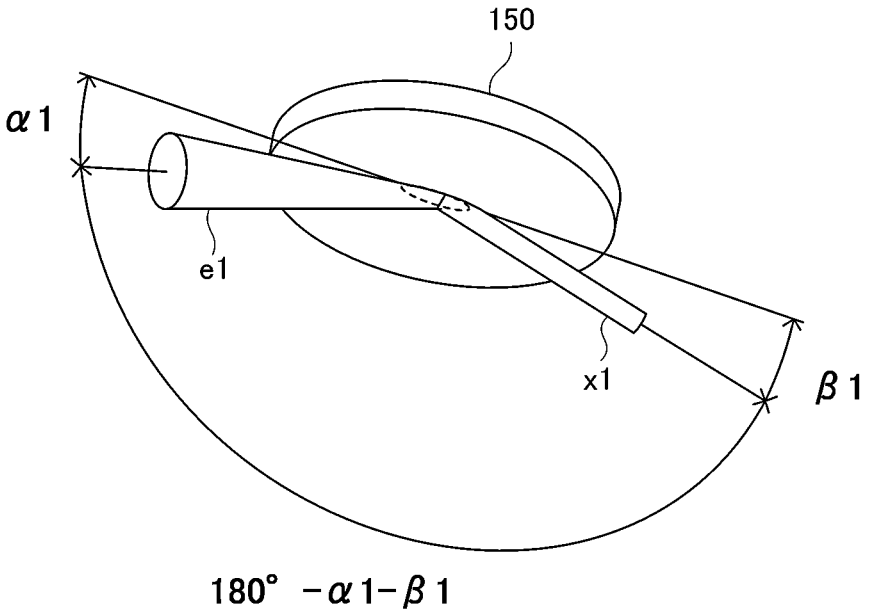
FIG. 2 is a perspective view illustrating an incident angle of an electron beam with respect to a target and an X-ray take-off angle.

FIG. 2 is a perspective view illustrating the incident angle $\alpha 1$ of the electron beam with respect to the target and the take-off angle $\beta 1$ of X-rays. As illustrated in FIG. 2, the target 150 is installed with its surface inclined with respect to the electron beam such that the incident angle $\alpha 1$ of the electron beam is 3 to 20 degrees. With this arrangement, without adjustment of the cross-sectional shape of the electron beam by a so-called stigmator, an irradiation area of the electron beam on the target can be increased, with the focus size remaining compact. In addition, a large load is applied without causing the target to reach the high temperature exceeding the melting point, and thus X-rays having high intensity can be extracted. As a result, the apparatus can be further more compact and simpler. A range surrounded with the broken line in FIG. 2 indicates an irradiation range of the electron beam on the target 150.

In an example illustrated in FIG. 2, the position of the X-ray extraction window 160 is installed at the position where the X-ray take-off angle $\beta 1$ with respect to the surface of the target 150 is almost the same angle as the incident angle $\alpha 1$ of the electron beam with respect thereto. In other words, the X-ray extraction window 160 is also installed at the position where the take-off angle $\beta 1$ is also almost the same angle as the incident angle $\alpha 1$ of the electron beam. Each of the incident angle $\alpha 1$ of the electron beam and the X-ray take-off angle $\beta 1$ can be set to be, for example, 15 degrees.

The X-ray extraction window 160 may be set such that the surface of the X-ray extraction window 160 is substantially parallel to the electron beam e1 and substantially vertical to the surface of the target 150. In the X-ray generating apparatus 100, the incident angle $\alpha 1$ with respect to the target 150 is small, and the target 150 is irradiated with the electron beam over a long range in the traveling direction of the electron beam. As a result, linearly-spread, line-focused X-rays that are to be radiated in the direction substantially parallel to the surface of the target 150 can be extracted via the X-ray extraction window 160.

First Example

It has been verified whether the X-ray generating apparatus 100 can generate X-rays with a sufficient small focus size and a sufficient high X-ray intensity through the use of the above-described X-ray generating apparatus 100 and the conventional X-ray generating apparatus 300.

Both of the apparatuses have been verified under conditions of a load on the target of 45 kV, 0.5 mA, in other words, 22.5 W, and the same temperature and atmospheric pressure. In addition, the same X-ray detector has been used for both of the apparatuses. Furthermore, the same distance condition has been used. In this manner, the generated X-ray spot has been detected. At this time, by the correction coil, the focus position has been adjusted in the traveling direction of the electron beam.

Figure 3:
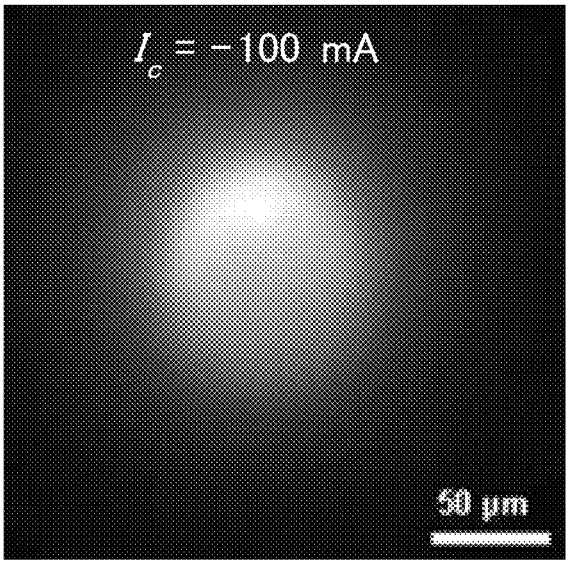
FIG. 3 is a diagram illustrating an X-ray spot when a correction coil is not sufficiently operated.

FIG. 3 is a diagram illustrating an X-ray spot when the correction coil is not sufficiently operated. FIG. 3 illustrates an example of the X-ray spot when currents of two alignment coils are each set to be 70 mA and 150 mA, and the current of the correction coil is set to be −100 mA.

Figure 4:
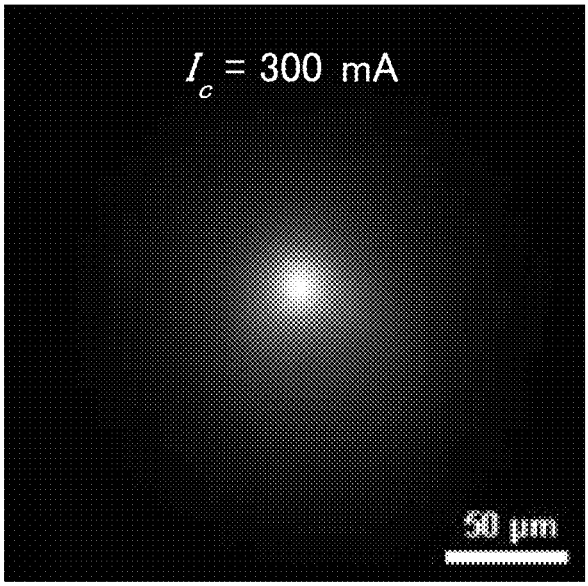
FIG. 4 is a diagram illustrating the X-ray spot when the correction coil is sufficiently operated.

FIG. 4 is a diagram illustrating an X-ray spot when the correction coil is sufficiently operated. FIG. 4 illustrates an example of the X-ray spot when the currents of the two alignment coils are each set to be 70 mA and 150 mA, and the current of the correction coil is adjusted to be 300 mA. In this manner, the focus position of the electron beam is adjusted by using the correction coil to reduce the size of the X-ray spot and increase its intensity, thereby being capable of generating a sharp peak in the X-ray spot.

Figure 5:
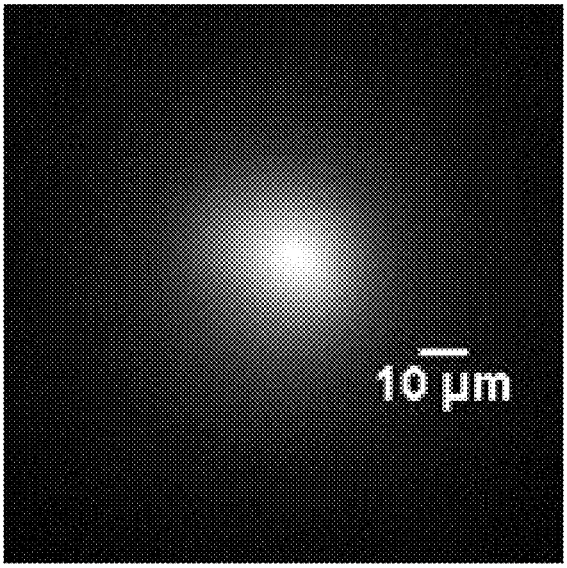
FIG. 5 is the X-ray spot obtained by the X-ray generating apparatus according to the first embodiment.
Figure 6:
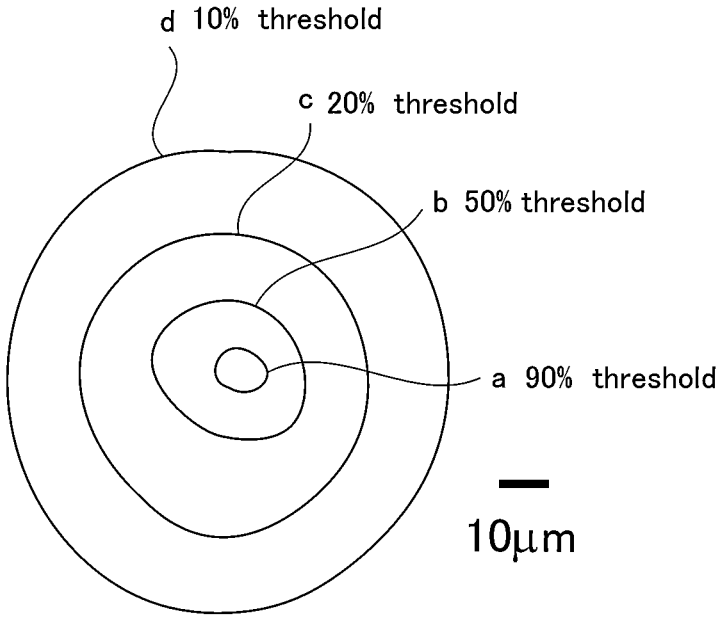
FIG. 6 is a diagram illustrating an intensity distribution of the X-ray spots.

FIG. 5 illustrates an X-ray spot obtained by the X-ray generating apparatus 100. FIG. 6 is a diagram illustrating an intensity distribution of the X-ray spots illustrated in FIG. 5. As illustrated in FIGS. 5 and 6, the X-ray spot with a great intensity and a sufficiently compact size can be obtained. FIG. 6 illustrates an accumulated intensity distribution where 90% of a threshold value is defined as "a", 50% thereof is defined as "b", 20% thereof is defined as "c", and 10% thereof is defined as "d".

FIG. 7 is a table illustrating an experiment result. The table summarizes evaluations of the X-ray spot obtained when both of the X-ray generating apparatus 100 (Example 1 in the table) and the conventional X-ray generating apparatus 300 (Example 3 in the table) are used. The almost same intensity and spot size can be obtained by both of the apparatuses. Therefore, it can be verified that, even if the X-ray generating apparatus has a compact and lightweight configuration, the intensity and sharpness of the X-ray spot compare favorably with those in the case of the conventional apparatus, as a micro-focus X-ray source. Meanwhile, the X-ray intensity is expressed by an output voltage value "mV" of an X-ray intensity detection meter.

Second Embodiment

Figure 8:
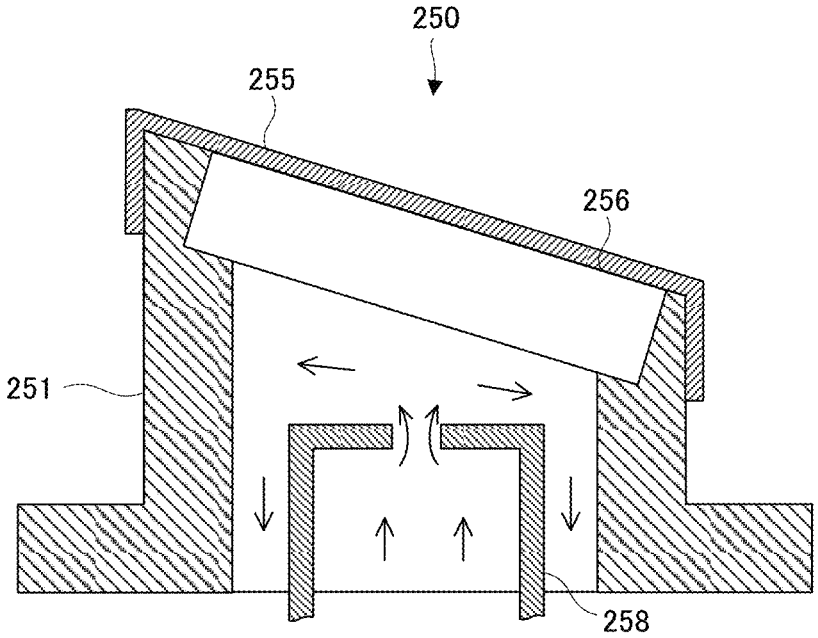
FIG. 8 is a cross-sectional view illustrating a target, obtained by forming a thin metal film on diamond.

According to the above-described embodiment, a target 250 is formed of a metal bulk, and may also be a thin metal film formed on the diamond. FIG. 8 is a cross-sectional view illustrating the target 250, which is the thin metal film formed on the diamond. The target 250 is hermetically jointed with a circular-plate-shape diamond plate 256 so as to cover an upper opening portion of a holder portion 251 formed of conductive material and formed into a cylindrical shape, and there is provided a target thin film 255 formed of the conductive material on a surface of the diamond plate 256. The target thin film 255 is provided extending to a side surface of the holder portion 251, and electrically connected to the holder portion 251.

An open end of the holder portion 251 is formed with a level difference having an inner diameter slightly larger than that of an inner peripheral surface of a cylinder, and the level difference has almost the same height as a thickness of the diamond plate 256 and is provided so as to be able to accommodate the diamond plate 256 inclined. The diamond plate 256 and the holder portion 251 are jointed with each other by brazing or the like.

Furthermore, the target thin film 255 is formed by a thin film deposition method such as ion beam spattering. An end portion of the holder portion 251 on a supported side is also hermetically joined. A cap 258 is provided inside the holder portion 251 and is configured such that cooling medium such as water can be circulated in a flow path formed between an inside and an outside of the cap 258. The thickness of the diamond plate 256 is preferably 300 μm to 800 μm.

The target is formed into a thin film, on the diamond substrate. With this arrangement, the heat generated on the thin film can be spread by the diamond. Furthermore, since the electron beam is premised on glancing incidence, even if the thin film for the target is made thinner, the incident electron acts on the target and a sufficient X-ray intensity is obtained.

Second Example

The thin Cu film for the target having an almost same configuration as the target 250 on the diamond plate having no inclination was sequentially irradiated with the electron beam reduced to 0.1 mm×1.1 mm (=focus size), and thus the stable X ray for a long period was obtained with the load of 5.4 kW/mm$^2$. A maximum load of the target depends on the focus size, and when the above-described value is converted into a focus size of 20 μm×80 μm, 40 kW/mm$^2$ can be obtained.

Figure 9:
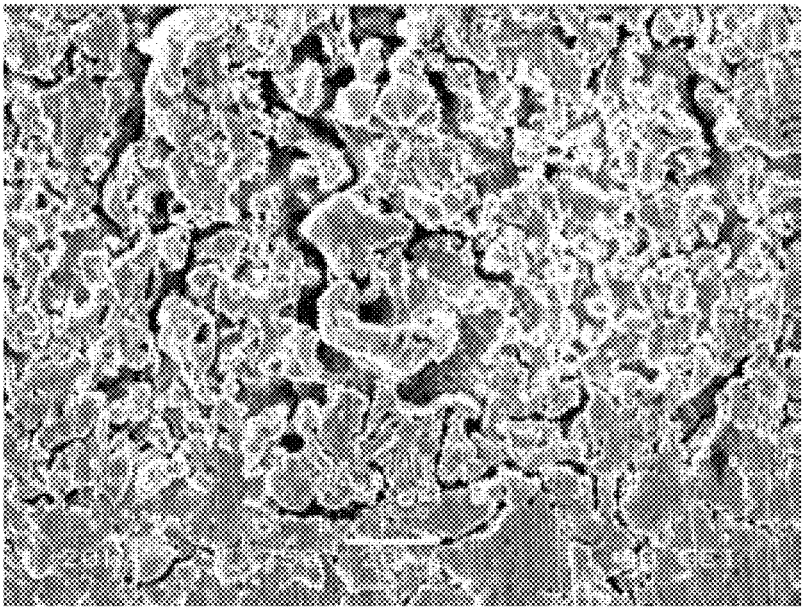
FIG. 9 is a diagram illustrating a state of a surface of a Cu bulk target after the completion of an X-ray generation experiment.

In contrast, in the case of the normal Cu target using the bulk Cu, the value is half or less. Meanwhile, FIG. 9 is a diagram illustrating a state of a surface of the Cu bulk target after the completion of an X-ray generation experiment. In the example illustrated in FIG. 9, the load of 40 kV, 11 mA (=440 W=4 kW/mm$^2$) is applied for approximately one hour, and it can be found that the surface is completely damaged.

Figure 10:
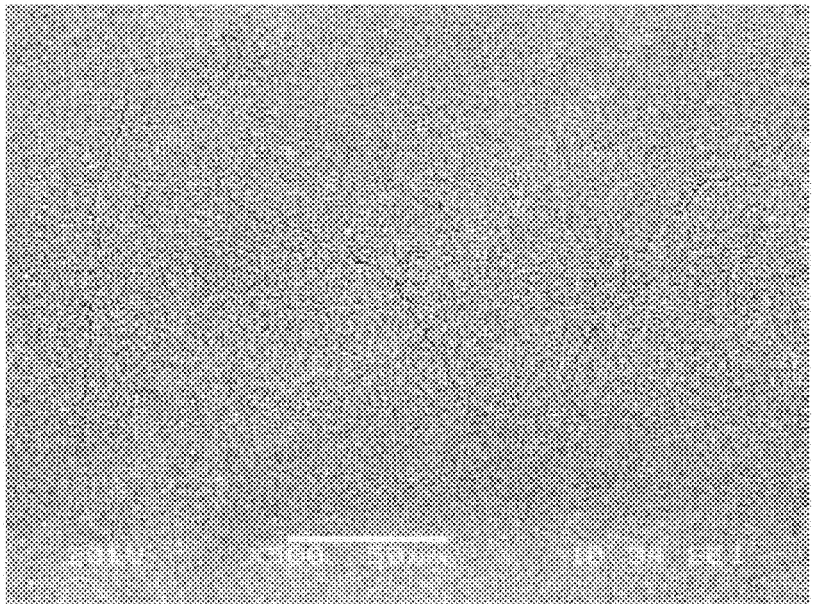
FIG. 10 is a diagram illustrating a state of a surface of a thin Cu film for a target on the diamond, after the completion of an X-ray generation experiment.
Figure 11:
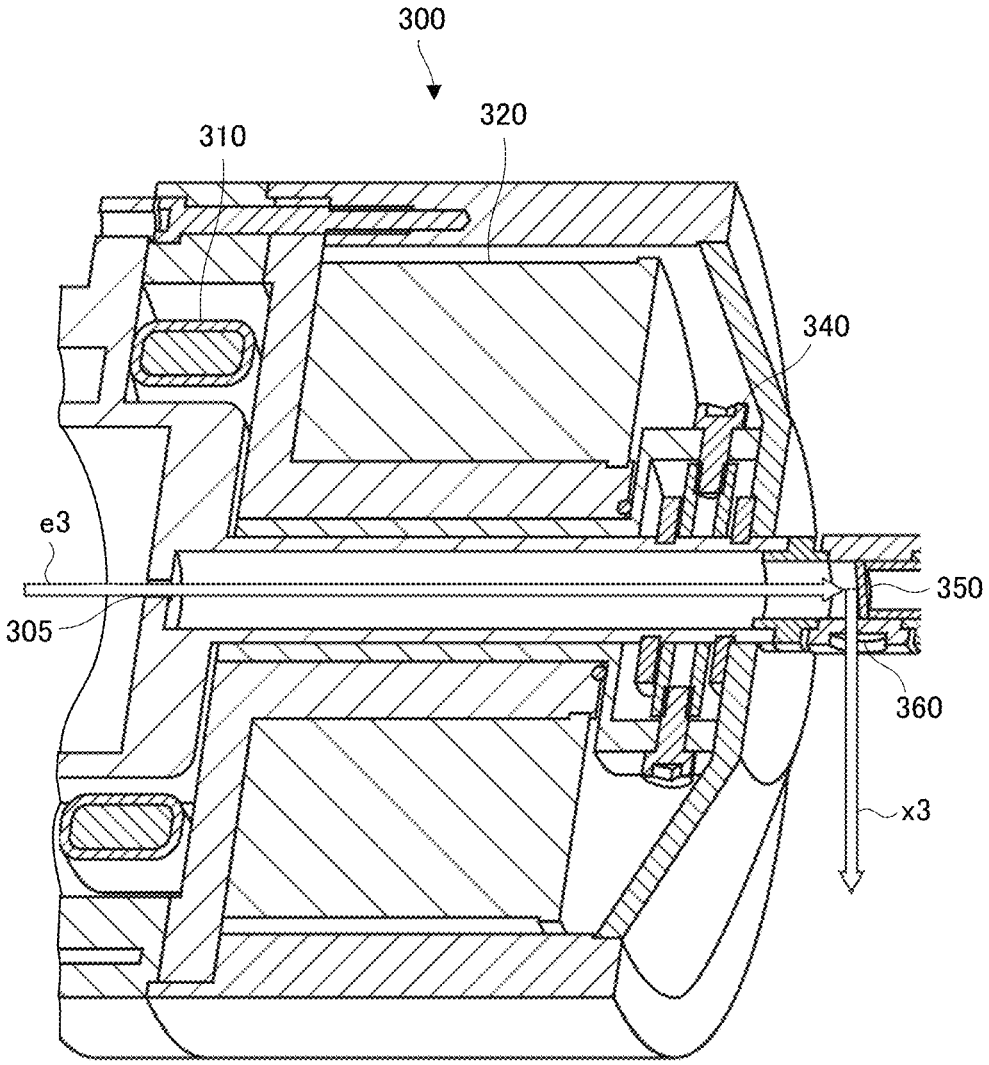
FIG. 11 is a perspective cross-sectional view illustrating a conventional X-ray generating apparatus.
Figure 12:
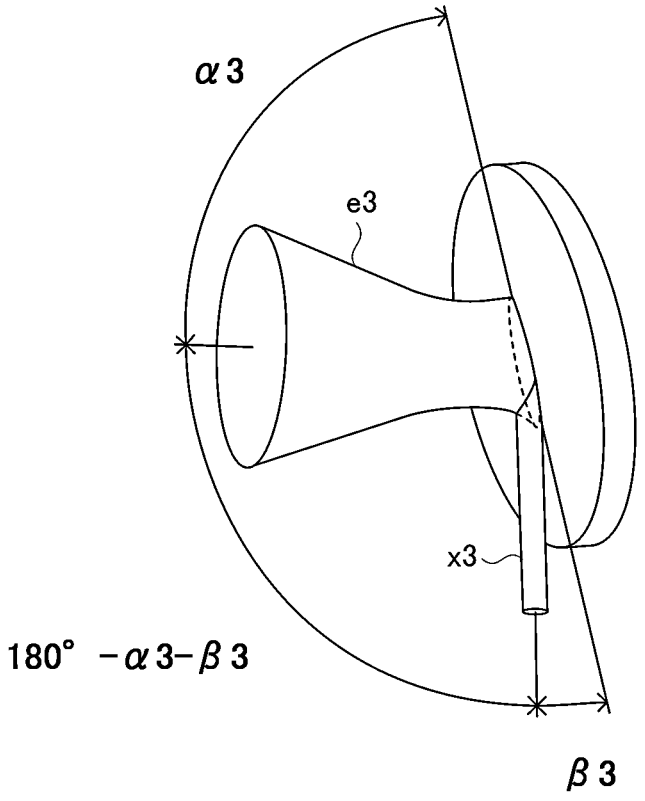
FIG. 12 is a perspective view illustrating an incident angle of electron beam with respect to a target and an X-ray take-off angle.

In contrast, FIG. 10 is a diagram illustrating a state of a surface of the thin Cu film for the target on the diamond after the completion of the X-ray generation experiment. In the example illustrated in FIG. 10, the load of 40 kV, 15 mA (=600 W=5.45 kW/mm$^2$) is applied for approximately 100 hours, and it can be found that the surface is totally normal. Meanwhile, both focus sizes can be obtained as 1 mm×1.1 mm.

What is claimed is:

1. An X-ray generating apparatus that applies electron beam onto a target to generate X-rays, the X-ray generating apparatus comprising:

a permanent magnet lens configured to focus the electron beam;

a correction coil provided between the electron beam and the permanent magnet lens and configured to correct a focus position in a traveling direction of the electron beam formed by the permanent magnet lens; and the target onto which the focused electron beam is applied.

2. The X-ray generating apparatus according to claim 1, wherein the correction coil is installed within a magnetic force range of a magnetic field of the permanent magnet lens in a traveling direction of the electron beam.

3. The X-ray generating apparatus according to claim 2, wherein the target is installed with a surface of the target inclined with respect to the electron beam such that an incident angle of the electron beam is 3 to 20 degrees.

4. The X-ray generating apparatus according to claim 3, further comprising:

an X-ray extraction window configured to extract X-rays generated on the target, outside the apparatus, wherein the X-ray extraction window is installed at a position where an X-ray take-off angle with respect to a surface of the target is almost a same angle as an incident angle of the electron beam with respect thereto.

5. The X-ray generating apparatus according to claim 3, further comprising;

an X-ray extraction window configured to extract X-rays generated on the target, outside the apparatus, wherein the X-ray extraction window is installed such that a surface of the X-ray extraction window is substantially parallel to the electron beam and substantially vertical with respect to a surface of the target.

6. The X-ray generating apparatus according to claim 3, wherein the target is formed into a thin film, on a diamond substrate.

7. An X ray generating apparatus that applies electron beam onto a target to generate X-rays, the X-ray generating apparatus comprising:

a permanent magnet lens configured to focus the electron beam;

a correction coil provided on a side of the electron beam with respect to the permanent magnet lens and configured to correct a focus position in a traveling direction of the electron beam formed by the permanent magnet lens; and the target onto which the focused electron beam is applied, wherein the target is installed with a surface of the target inclined with respect to the electron beam such that an incident angle of the electron beam is 3 to 20 degrees.

8. The X-ray generating apparatus according to claim 7, further comprising:

an X-ray extraction window configured to extract X-rays generated on the target, outside the apparatus, wherein the X-ray extraction window is installed at a position where an X-ray take-off angle with respect to a surface of the target is almost a same angle as an incident angle of the electron beam with respect thereto.

9. The X-ray generating apparatus according to claim 7, further comprising:

an X-ray extraction window configured to extract X-rays generated on the target, outside the apparatus, wherein the X-ray extraction window is installed such that a surface of the X-ray extraction window is substantially parallel to the electron beam and substantially vertical with respect to a surface of the target.

10. The X-ray generating apparatus according to claim 7, wherein the target is formed into a thin film, on a diamond substrate.

* * * * *